United States Patent [19]

Loikitz

[11] 4,205,867

[45] Jun. 3, 1980

[54] LATCH MECHANISM

[75] Inventor: Frank F. Loikitz, Middletown, N.J.

[73] Assignee: Buildex Incorporated, Huntington, N.Y.

[21] Appl. No.: 871,584

[22] Filed: Jan. 23, 1978

[51] Int. Cl.[2] ..... E05C 3/16

[52] U.S. Cl. ..... 292/223

[58] Field of Search ..... 292/123, 223, 108, 210, 292/167, 168, 97, DIG. 71

[56] References Cited

U.S. PATENT DOCUMENTS

| | | | |
|---|---|---|---|
| 2,256,447 | 9/1941 | Burke | 292/223 |
| 2,893,772 | 7/1959 | Edwards | 292/123 X |
| 3,045,465 | 7/1962 | Larson | 292/223 X |
| 3,446,524 | 5/1969 | Barry | 292/223 |

*Primary Examiner*—Richard E. Moore

*Attorney, Agent, or Firm*—Blum Kaplan Friedman Silberman & Beran

[57] ABSTRACT

An edgemounted latch mechanism that is tamper-resistant is provided. An internal locking mechanism is adapted to lock simultaneously both a locking arm and a catch assembly. The catch assembly is constantly forced against a keeper member to assure a constant seal of the door to its gasket or door frame. The mechanism has provision for insertion of an external lock such as a padlock in order to secure the handle with respect to the latch housing and with respect to the locking arm.

15 Claims, 4 Drawing Figures

LATCH MECHANISM

BACKGROUND OF THE INVENTION

This invention relates generally to a latch mechanism and, in particular, to a latch mechanism that is suitable for edgemounting. While a variety of edgemount latch mechanisms are known in the art, these mechanisms have generally been less than completely satisfactory with regard to tamper-resistance. Heretofore, locking mechanisms locked only one of the linkages within the latch mechanism thereby allowing the locking mechanism to be bypassed. Furthermore, latch mechanisms have not provided a sufficient force to maintain the door against the gasket and door frame when the latch mechanism is in a latched position. The instant invention provides a construction directed to overcoming the aforenoted disadvantages.

SUMMARY OF THE INVENTION

Generally speaking, in accordance with the invention, a latch mechanism especially suitable for edgemounting is provided. An internal locking cam, operated by a cylinder assembly, is adapted to lock both the catch assembly and the locking arm against displacement. The locking cam also provides for a transfer of any forces occurring from attempts to force the handle open. The geometry of the catch assembly and keeper member is constructed and arranged so that the latch assembly, and the door to which same is secured, is constantly urged towards its gasket or door frame when the catch assembly is disposed in a latched position.

An external padlock can be used to lock the mechanism. The padlock will lock the handle with respect to both the housing supporting the latch mechanism and with respect to the locking arm.

Accordingly, it is an object of this invention to provide an improved latch mechanism having an internal lock capable of locking both the locking arm and the catch.

Another object of this invention is to provide an improved latch mechanism having an internal lock assembly for providing greater resistance to tampering.

A further object of this invention is to provide a latch mechanism that urges the door towards its gasket or door frame when the mechanism is latched.

Still another object of this invention is to provide an improved latch mechanism capable of receiving an external lock attached to the handle for locking both the handle and the internal linkages of the latch.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
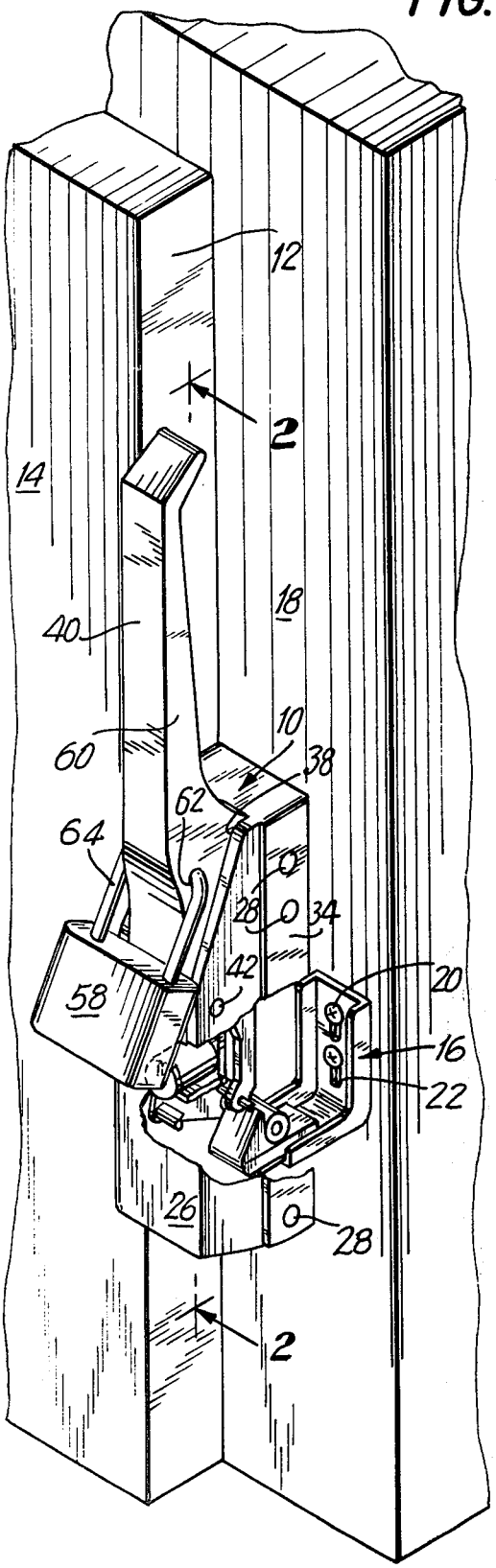
FIG. 1 is a perspective view of a latch mechanism constructed in accordance with the instant invention, shown attached to a door and door frame.

The drawings illustrate an edgemount latch assembly 10 mounted to the edge 12 of a hinged door 14. A keeper housing 16 is mounted to door frame 18 through a keeper plate 24 by screws 20 riding in elongated slots 22 so that the vertical position of keeper housing 16 may be adjusted. A latch housing 26 includes countersunk openings 28 extending therethrough for receiving mounting screws 30 to effect mounting of the housing 26 to edge 12 of door 14. Housing 26 includes opposed side walls 32, 34 and a rear wall 36 which extends approximately half-way down the lengthwise extent of housing 26. The housing 26 defines front opening 38 through which a handle 40 extends.

Handle 40 is pivotally mounted to housing 26 by means of a pin 42 secured at its respective ends by side wall 32 and side wall 34. The pin 42 pivotally secures the handle in the housing by extending through an opening 44 in handle 40. Handle 40 is normally biased towards door frame 18 (direction A) by a handle spring 46. The handle spring 46 includes a coiled portion 48 surrounding pin 42 and a first end 50 mounted within a recess 52 positioned in the rearward portion of housing 26. A second end 54 of the spring 46 is positioned in abutment with inwardly extending wall 56 of handle 40. Handle 40 may be locked to prevent pivoting by positioning the loop 64 of a padlock 58 in a throughhole 62 extending between opposed side walls 60. When latch assembly 10 is in a closed position, openings 62 will be in registry with an opening 66 provided in a plate 68 extending from housing 26 so that loop 64, of the padlock, may extend through openings 62 and 66 and thereby lock the handle and thereby prevent same from pivoting with respect to housing 26.

Handle 40 includes a pair of inwardly extending arms 70 having openings 72 for receiving a pin 74 therein. Pin 74 rides in a slot 76 provided in a slideable locking arm 78. When handle 40 is pivoted away from door 18 (direction B) locking arm 78 will be displaced upwardly (direction C) by means of the action of pin 74 in slot 76. Locking arm 78 has a tapered extension 80 mounting an annular bushing 82 which is L-shaped in cross-section. Bushing 82 engages a first end of a coiled compression spring 84, the other end of which is disposed in abutment against a wall 86 disposed in housing 26. Compression spring 84 biases locking arm 78 in direction D. A forward portion 88, of locking arm 78, includes an opening 90 through which a catch pin 92 extends.

A catch, generally indicated as 94, includes a pair of opposed side walls 96 joined by a transverse wall 98. Catch 94 is pivotally mounted to housing 26 by pin 104 extending through opening 102 formed in tabs 100 projecting from the front wall of the housing. An opening 106 is formed in the side walls 96 of the catch to receive pin 104. The other end of catch 94 mounts a roller 108 carried by a pin 110 mounted to and extending between side walls 96.

A keeper housing 114 is mounted to keeper plate 30 by a screw 111 and lock washer 112. Keeper housing 114 includes an inclined surface 116 extending through a rounded edge 120 to a concave surface 118 having a radius substantially equal to the radius of roller 108. As door 14 is swung from an open position to a closed position, roller 108 will contact inclined surface 116 and thereafter roll along same. Catch 94 will simultaneously be pivoted about pin 104 (direction E) and thereby displace locking arm 78 (direction C) against the force of compressing spring 84 (direction C). After rolling along inclined surface 116, roller 108 will clear rounded edge 120 and then nest into engagement with concave surface 118. When the roller 108 clears rounded edge 120, catch 94 will reverse its direction of rotation (direction F) causing locking arm 78 to be displaced downward (direction D) by the force of compression spring 84.

The geometry of catch 94, locking arm 78 and keeper housing 114 is arranged so that the action of compression spring 84 causes door 14 to fit snugly against frame 18 in the closed position. This snug fit is accomplished by locating the pivot of catch 94, with respect to housing 26, so that the roller 108 will be biased into contact with concave surface 118 by the action of compression spring 84. The constant biasing force transmitted through locking arm 78 and catch 94 presses roller 108 (direction F) against concave surface 118 which causes latch housing 26, and the door 14 to which same is attached to be forced in the direction of door frame 18. In the latched position, illustrated in FIG. 2, roller 108 is located beyond the center line X-X of the pivotal axis of catch 94, so that the bias of spring 84 acts through locking arm 78 and catch 94 (direction F) to cause latch housing 26 to be biased in the direction of door frame 18. This feature allows for constant compression of any door gasket (not shown) or sealing door 12. Accordingly, when door 14 is in the position shown in FIG. 2 the biasing force exerted upon concave surface 118 of keeper housing 114 will have a component in a direction perpendicular to and away from door frame 18.

Latch assembly 10 may be locked either by means of an external padlock or an internal key operated mechanism. As noted above, when loop 64 of padlock 58 is inserted in openings 62 of side walls 60 of handle 40 it will extend through an opening 66 in plate 68 which will pivotally lock handle 40 with respect to latch housing 26. Locking arm 78 includes a tail 124 which extends between the side walls 60 of handle 40. The end wall 126 of tail 124 is located proximate to throughhole 66 in plate 68 so that it will also be positioned proximate to loop 64 of padlock 58. This proximity will prevent locking arm 78 from being slideably displaced which, in turn, prevents pivoting of catch 94. In previous lock constructions, provisions were often made to lock the handle with respect to the latch housings. However, the locking arm was free to move even when the handle was locked, thereby permitting it to be unlocked. A lock, constructed in accordance with the present invention, decreases such a possibility by locking both handle 40 and locking arm 78 against movement, when a padlock 58 is utilized therewith.

Latch assembly 10 also contains an internally mounted key operated locking arrangement. Latch housing 26 includes a mounting flange 128 for positionally securing a locking cylinder 130 operated by key 132. The mounting flange may be integrally cast with housing 26 and cylinder 130 may be of any suitable type which allows rotation when actuated by a key. Mounted for rotation upon insertion and rotation of key 132 is a locking cam 134 mounted to cylinder 130 by means of a screw 136. Locking cam 134 is so arranged to lock both locking arm 78 and keeper 94 against movement when cylinder 130 is positioned in a locked position. Locking cam 134 includes a section 139 which is normal to the axis of rotation of cylinder 130 and rotates therewith an arcuate section 140 extending perpendicularly with respect to section 138. The upper surface 142 of arcuate section 140 is concave when viewed in a direction parallel to that of locking arm 78. Section 138 includes an arcuate recess 144 in which a stop 146, extending from latch housing 26, rides. Stop 146 and recess 144 prevent locking cam 134 from rotating more than 90°.

Figure 2:
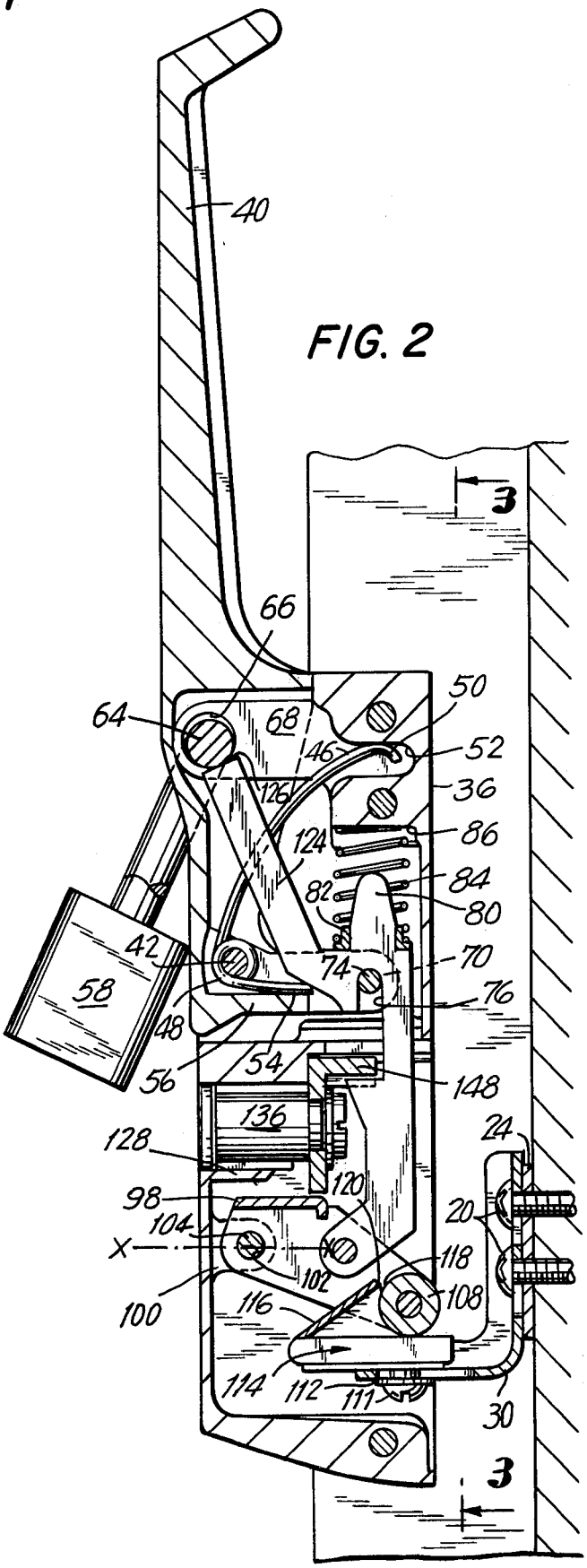
FIG. 2 is a sectional view taken along line 2—2 of FIG. 1.
Figure 3:
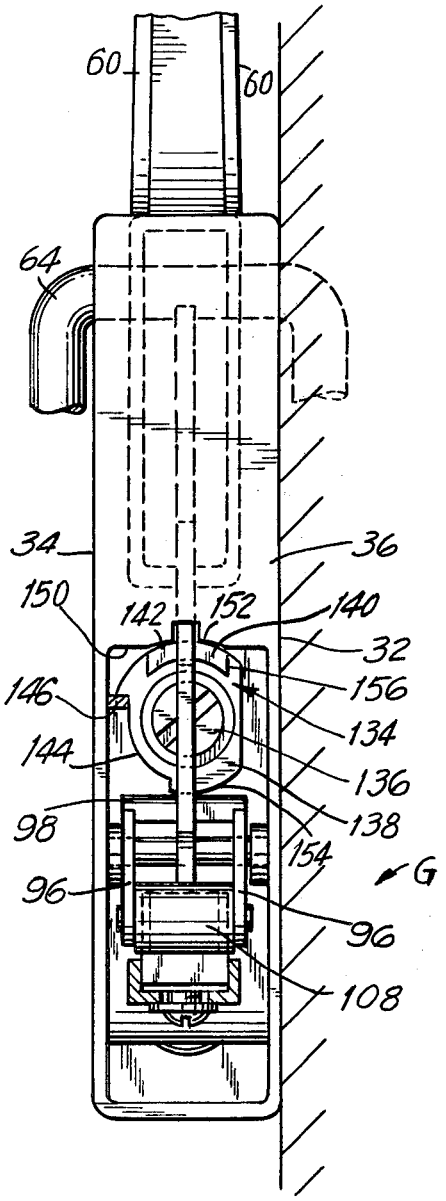
FIG. 3 is a sectional view taken along line 3—3 of FIG. 2.
Figure 4:
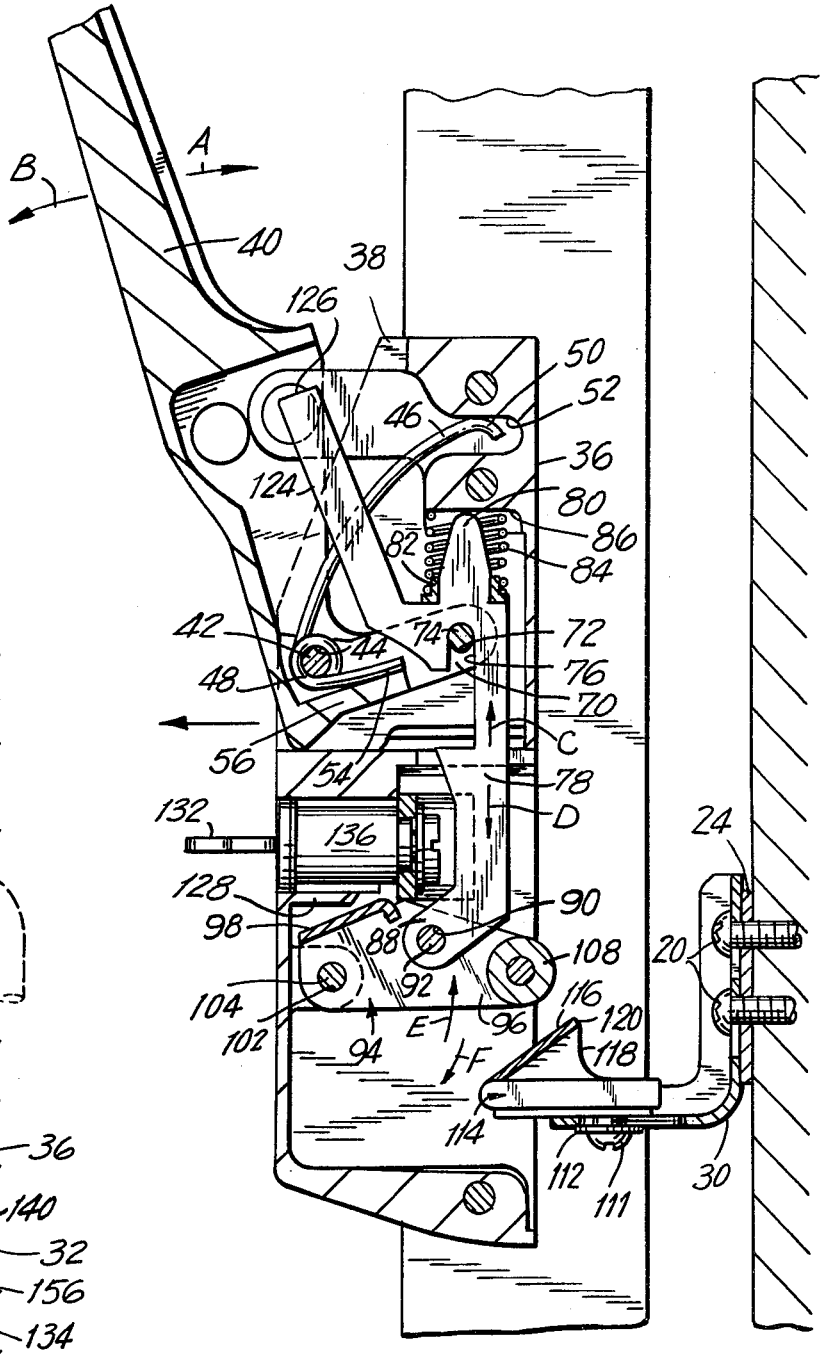
FIG. 4 is a sectional view corresponding to that of FIG. 2 with the latch handle actuated and the latch in an unlatched condition with the door ajar.

FIGS. 2 and 3 illustrate locking cam 134 in a locked position. In a locked position, arcuate section 140 will be disposed between a transverse wall 148 of locking arm 78 and a transverse wall 150 extending from side wall 32 to side wall 34 of latch housing 38. Transverse wall 150 includes a concave section 152 corresponding in curvature to arcuate section 140 of locking cam 134. If force is exerted on handle 40, when locking cam 134 is in its locked position, locking arm 78 is rendered immobile by the abutment of wall 148 of locking arm 78 against arcuate section 140, which section in turn abuts concave portion 152 of transverse wall 150. This construction in which the locking cam contacts both the locking arm 78 and a transverse wall 150 of latch housing 26 permits a transfer of forces to the latch housing itself. This transfer of forces results in superior locking action since the latch housing 26, in addition to the cylinder mounting 128, instead of cylinder mounting 128 alone, resists any forcible opening thereof.

Furthermore, as is illustrated in FIGS. 2 and 3, catch 90 is also rendered immobile when locking cam 134 is in a locked position. In a locked position, surface 154 of section 138 of locking cam 134 will be positioned proximate to wall 98 of catch 94, so that any attempt at forcing the catch will position wall 98 in abutment with surface 154. By rendering both locking arm 78 and catch 94 immobile, the latch assembly is further insulated against tampering.

To unlock the assembly, key 132 is inserted in cylinder 130 and rotated 90° (direction G) which rotation causes locking cam 134 to rotate 90°. After rotation, arcuate section 140 will not be interposed between wall 148 of locking arm 78 and wall 150 to thereby permit locking arm 78 to be displaced upwardly (direction C) by the action of handle 40. Similarly, edge 154 will be displaced out of engagement with wall 98 of catch 94 and wall 156 will be spaced apart from wall 98 to permit catch 94 to be disengaged from keeper assembly 146 by its pivotal action.

The above described construction for an edgemount door latch provides a latch having a high degree of security. The latch may be locked by an internal lock which renders both locking arm 78 and catch 94 immobile. An external lock, such as padlock 58, can also be utilized to render locking arm 78 immobile. Furthermore, the pivotal mounting and location of catch 94 with respect to keeper member 114 assures that the force of compression spring 84 will continue to bias door 12 in the direction of door frame 18 when the latch is in a locked position.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A latch mechanism for engagement with a keeper member comprising a latch housing, displaceable catch means for engagement with said keeper member and displaceable into a position to be locked, a displaceable arm operatively coupled to said catch means for operation thereof to move said catch means into and out of said locked position, and internal locking means disposed proximate to said catch means and said operatively coupled arm, said internal locking means being displaceable between a first position at which said catch means and said arm are displaceable from said locked position and a second position at which said locking means physically blocks both said catch means and said arm from being displaced from said locked position.

2. A latch mechanism as claimed in claim 1 and including a latch housing, manually operable handle means, said displaceable arm being operatively coupled to said handle means for operation thereby, an opening in said handle means, said opening in said handle means allowing the insertion of an external locking means, a member fixed to said latch housing, said fixed member including a opening positioned to receive an external locking means when same is inserted through said opening in said handle, said displaceable arm being positioned proximate to said opening in said fixed member to prevent displacement of said arm and thereby prevent opening of said latch when said external locking means is inserted in said opening.

3. A latch mechanism as claimed in claim 1, wherein said catch means is pivotally mounted to said latch housing and is also pivotally mounted to said displaceable arm, said handle means being operatively coupled to said arm to effect displacement thereof in response to manual operation of said handle means.

4. A latch mechanism as claimed in claim 1, wherein said handle means includes a hollow portion, said fixed member being disposed within said hollow portion.

5. A latch mechanism as claimed in claim 1, wherein said displaceable arm includes biasing means actuatable through said arm for biasing said catch means into engagement with said keeper member.

6. A latch mechanism as claimed in claim 1, wherein said catch means is pivotally displaceable, said displaceable arm being pivotally joined to said catch means.

7. A latch mechanism as claimed in claim 6, wherein said internal locking means includes a locking cam mounted for rotation to a lock cylinder rotatable upon insertion therein of an external key, said locking cam including a first surface for engagement with said catch means and a second surface for engagement with said displaceable arm at said second position of said locking means.

8. A latch mechanism as claimed in claim 7, wherein said respective first and second engagement surfaces of said locking cam are perpendicularly oriented with respect to each other.

9. A latch mechanism as claimed in claim 8, wherein said latch housing supports a transverse wall, said displaceable arm having a surface parallel to said second surface of said locking cam, said second surface of said locking cam in said second position being proximate to said parallel surface of said locking cam and said transverse wall so that upon displacement of said arm, said parallel surface of said arm is disposed in abutment against said second surface of said locking cam and said second surface of said locking cam is disposed in abutment with said transverse wall to evenly distribute the force of said displacement.

10. A latch mechanism as claimed in claim 9, wherein said transverse wall is integrally formed with said latch housing.

11. A latch mechanism as claimed in claim 6 and including bias means for resiliently biasing said pivotal catch means into engagement with said keeper member, the arc of the pivot of said catch means being constructed and arranged so that said catch means is biased against said keeper member when said catch means is engaged therein.

12. A latch mechanism as claimed in claim 11, wherein said catch means includes an end remote from the position that same is pivotally secured to said latch housing, said arm being pivotally mounted to said catch means between said pivot and said remote end.

13. A latch mechanism as claimed in claim 12, wherein said arm engages said catch means at a position between the center line of said point of pivoting of said catch means and the position that said catch means engages said keeper member.

14. A latch mechanism as claimed in claim 13, wherein said keeper member includes an inclined surface for permitting a remote end of said catch means to slide thereagainst and an engaging surface for engaging the remote end of said catch means.

15. A latch mechanism as claimed in claim 14, wherein said remote end of said catch means includes a rotatably mounted roller and said engaging surface is shaped to receive said roller.

* * * * *